United States Patent [19]

Fleckenstein et al.

[11] 4,178,723

[45] Dec. 18, 1979

[54] GUIDE WHEELS FOR BELT GRINDER

[75] Inventors: Elwin H. Fleckenstein, Alden; Walter N. Welsch, Tonawanda, both of N.Y.

[73] Assignee: Dynabrade, Inc., Tonawanda, N.Y.

[21] Appl. No.: 939,425

[22] Filed: Sep. 5, 1978

[51] Int. Cl.[2] ..... B24B 23/06

[52] U.S. Cl. ..... 51/170 EB; 51/174

[58] Field of Search ..... 51/170 EB, 170 PT, 170 R, 51/176, 174

[56] References Cited

U.S. PATENT DOCUMENTS

| | | | |
|---|---|---|---|
| 1,727,524 | 9/1929 | Spencer | 51/176 |
| 1,917,906 | 7/1933 | Schulte | 51/170 PT |
| 3,427,757 | 2/1969 | Redman | 51/170 EB |
| 3,648,413 | 3/1972 | Godwin | 51/170 PT |

*Primary Examiner*—Robert L. Spruill
*Assistant Examiner*—Roscoe V. Parker
*Attorney, Agent, or Firm*—Bean, Kauffman & Bean

[57] ABSTRACT

A pair of guide wheels (6) for a hand held abrading device (1) of the endless abrasive belt (2) variety for preventing slewing, side slipping and gouging of the surface of a workpiece (8) when a raised imperfection (9) such as a weld bead is abraded to be flush with the surface (10). The guide wheels (6), mounted on the axle (5) of the contact wheel (3) of the device, are circumferentially adjustable to compensate for different radial dimensions of the sum of the thickness of the abrasive belt and the radius of the guide wheel and include a resilient tire guide ring (11) and a circumferentially round guide surface (12) having different radii at different lateral positions.

12 Claims, 4 Drawing Figures

Fig. 1.
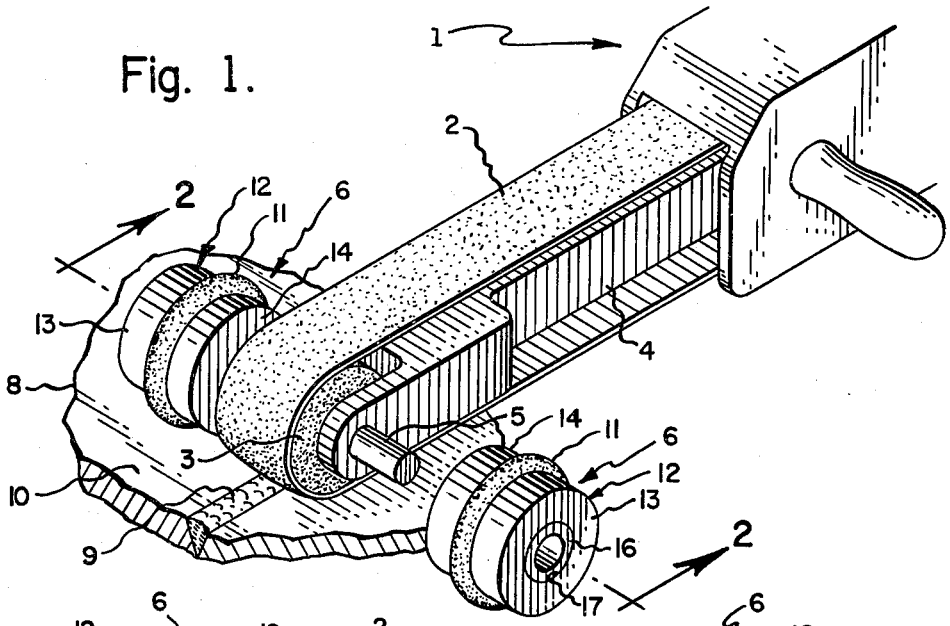
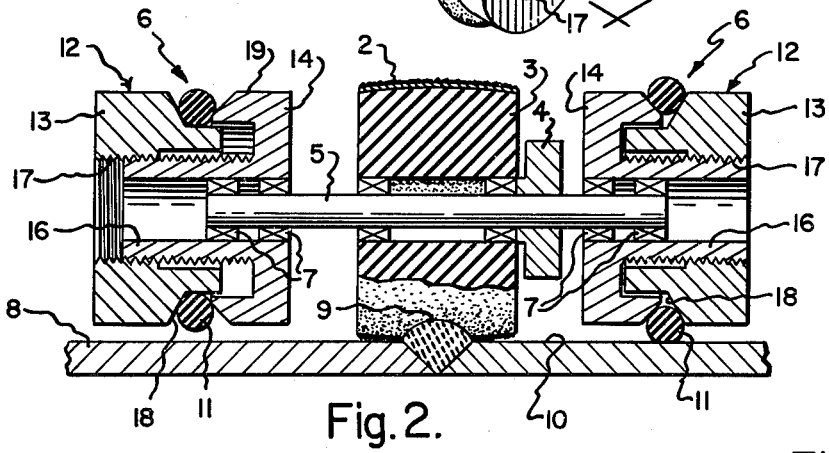
Fig. 2.
Fig. 3.
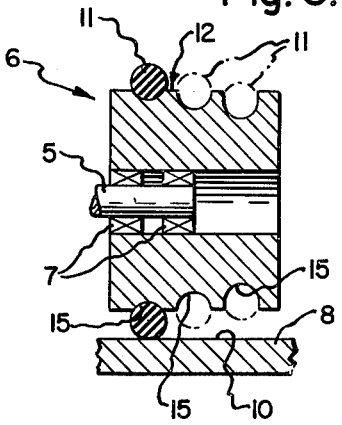
Fig. 4.
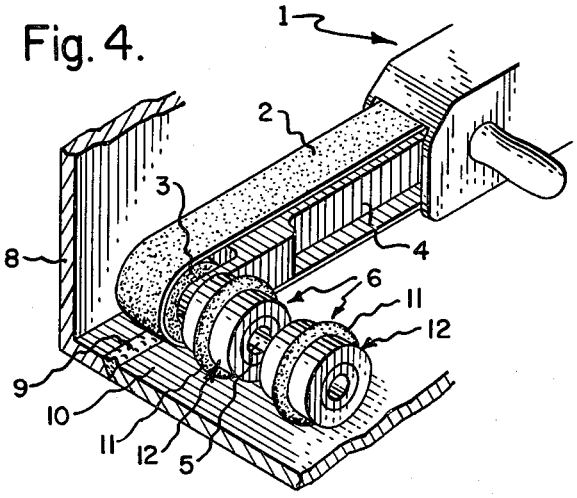

GUIDE WHEELS FOR BELT GRINDER

TECHNICAL FIELD OF THE INVENTION

The present invention relates to the general field of grinders, sanders and buffers. More particularly, the invention relates to a hand held abrading device of the endless belt variety and guides therefor to prevent slewing, side slipping and gouging when a raised imperfection in a workpiece is abraded to be flush with the surface of the workpiece.

BACKGROUND OF THE INVENTION

In many industrial applications, it is desireable to remove a surface imperfection such as a burr or a weld bead in a manner which leaves the surface perfectly smooth. Accordingly, hand held grinders or sanders are conventionally employed to this end. Such grinders or sanders generally fall into two classes: broad abrasive belt devices and relatively narrow abrasive belt devices. In each of these classes the devices may be further subdivided into vibrating belt and endless belt devices in which the endless belt is entrained over a pulley or support member.

Of the various types of grinders or sanders available, the narrow endless belt variety has found wide industrial acceptance due to its maneuverability, flexibility in confined areas and small relative cost. One such device is exemplified in U.S. Pat. No. 3,427,757. However, when one attempts to use such a grinder for removing an elongated ridge from a planar surface, such as a longitudinally extending weld bead, difficulties may be encountered. The hand held grinder is apt to slew from side to side or to gouge below the surface of the workpiece to produce a marred, uneven or otherwise generally unsatisfactory finished product. It is therefore evident that a need exists for an apparatus which enables a hand held, narrow, endless abrading belt grinder device to be used for grinding surface imperfections in a manner which results in a perfectly smooth and even finished planar surface. The apparatus should furthermore be easily adjustable to compensate for changes in thickness of the abrasive belt as it wears or when a belt of different thickness is substituted for the previously used belt.

THE INVENTION

Such an apparatus has been discovered and is the subject of this patent. The invention comprises one or more circumferentially expandable guide wheels laterally mounted on the axle of the contact wheel of the abrading device. The guide wheels each include a circumferentially round continuous guide ring or tire on its outer surface and means for adjustably varying the radius of the guide ring.

In its preferred form the guide ring is a resilient annular tire mounted on a conical surface of the guide wheel. An axially extending collar, laterally translatable relative to the conical surface, is provided to adjustably position the resilient tire at various positions along the conical surface so as to adjust the radius of the guide ring in a manner which permits compensation for variations in the thickness of the abrasive belt.

In a second embodiment, the cylindrically symmetrical guide surface of the guide wheel includes a plurality of annular grooves of differing radial depths. Accordingly, circumferential expansion of the guide ring is controlled by its placement in one of the plurality of grooves.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which:

FIG. 1 is a perspective view of an endless belt grinding apparatus generally illustrating the guide wheels of the present invention;

FIG. 2 is a cross-section elevational view of the guide wheels and the contact wheel of the grinder illustrated in FIG. 1 taken along the view lines 2—2;

FIG. 3 is a cross-section elevational view similar to that shown in FIG. 2 of a different embodiment of the invention; and FIG. 4 is a perspective view of a second embodiment having a pair of guide wheels disposed on the same side of the grinding apparatus.

DESCRIPTION OF THE BEST MODE OF THE INVENTION

While the invention is susceptible of various modifications and alternative constructions, there is shown in the drawings and there will hereinafter be described, in detail, a description of the preferred or best known mode of the invention. It is to be understood, however, that the specific description and drawings are not intended to limit the invention to the specific form disclosed. On the contrary, it is intended that the scope of this patent include all modifications and alternative constructions thereof falling within the spirit and scope of the invention as expressed by the appended claims to the full range of their equivalents.

Referring now to FIGS. 1 and 4, two alternative applications of the guide wheels of the present invention to a hand held endless abrasive belt abrading device or grinder are illustrated. In the figures the grinder is generally illustrated at 1 and includes an endless abrasive belt 2 entrained over a contact wheel 3 held at a distance from the body of the grinder by a contact arm 4. Contact wheel 3 is rotationally mounted on a transversely extending axle 5 which is supported on the end of contact arm 4. Grinder 1 is shown grinding a weld bead surface imperfection 9 in a workpiece 8 in order to reduce it to be flush with the planar surface 10 of the workpiece. Avoidance of the difficulties encountered by the prior art devices of slewing, side slipping, and gouging of the surface by the hand held grinder is accomplished by providing a pair of guide wheels 6 in accordance with the present invention to support and guide the end of the abrading device 1. In FIG. 1, the guide wheels 6 are shown on opposite sides of contact wheel 3 while in FIG. 4 the guide wheels are shown on the same side of contact wheel 3 to enable grinding an imperfection which lies close to a corner of the workpiece 8 as shown or which lies close to an edge of the workpiece 8 (not shown).

Guide wheels 6 are mounted laterally of contact wheel 3 on lateral extensions of the axle 5. In general, the guide wheels 6 include a cylindrically symmetrical support surface having different radial dimensions at different axial positions and a circumferentially round continuous guide ring 11 mounted on and supported by the support surface 12. Inasmuch as support surface 12 is a cylindrically symmetrical surface with different radial dimensions at different axial positions, it will be recognized that the diameter of guide ring 11, which preferably consists of a resilient annular rubber or urethane tire, is affected by the axial positioning of the tire 11 along the surface 12. Accordingly, means are provided for determining the axial position of tire 11 along surface 12 so that the diameter of the tire 11 may be adjusted to correspond with twice the sum of the radius of contact wheel 3 and the thickness of the abrasive belt 2. When properly adjusted in this manner, guide wheels 6 and traction tires 11 are effective not only to prevent side slipping but also to prevent gouging below the surface 10 of the workpiece 8.

FIGS. 2 and 3 show two alternative embodiments of the guide wheels of the present invention. Looking at FIG. 3 first, it can be seen that guide surface 12 is a cylindrically symmetrical surface having a plurality of annular grooves 15 of different depths formed therein provided for receiving and positioning tire 11. As will be recognized, the location of tire 11 in one of the grooves determines the effective diameter of the guide wheels 6 inasmuch as the bottom of each of the annular grooves 15 has a diameter different from the diameters of the other grooves.

Turning now to an examination of FIG. 2, the preferred embodiment of the guide wheels of the present invention is disclosed as including first and second cylindrically symmetrical members 13 and 14 respectively; each being axially threaded to engage the other so that relative rotation of one with respect to the other causes relative axial movement therebetween. First member 13 is configured as having an internal threaded bore 17 and an external support surface 12 which includes a conical portion 18 having a plurality of different radii at different axial locations. Second member 14 is shown as including an externally threaded tubular portion 16 and an axially extending annular collar or flange 19. As will be evidenced from an examination of FIG. 2, and from an understanding of the present invention, axial movement of second member 14 relative to first member 13 in a telescopically shortening fashion causes annular tire 11 to be forced to different axial positions along guide surface 12, each position corresponding to a different circumferential dimension of tire 11. The two extreme adjusted positions are shown in the right and left hand guide wheels as illustrated in FIG. 2 while all positions intermediate these two extremes are possible. Accordingly, the configuration of minimum diameter is shown in the left hand side of FIG. 2 in which second member 14 is axially withdrawn from first member 13 so that resilient tire 11 assumes a condition of minimum diameter. On the other hand, the right hand portion of FIG. 2 shows a configuration in which second member 14 has been axially advanced toward first member 13 so that tire 11 is forced up the conical surface 18 to a position of maximum diameter.

As will be noted, wheels 6 are rotationally mounted on lateral extensions of axle 5 by way of bearings 7 so that first and second members 13 and 14 respectively may rotate as a unit as the abrading device and the guide wheels are advanced along the surface of workpiece 8. Additionally, it will be recognized that the right and left hand guide wheels may be differentially adjusted to accommodate a step in workpiece 8 which causes surface 10 to be higher on one side of the surface imperfection than on the other.

While a preferred embodiment has been illustrated and described, it should be recognized that other embodiments which fall within the intent and scope of the claims are possible. Thus, the guide wheels of the present invention may be utilized with equally desireable results in association with a vibrating grinder which lacks a contact wheel but which includes a support member which provides backup support for the belt. Additionally, the inventive guide wheel is ideally suited for utilization in combination with a grinding wheel abrading device or a cutting wheel abrading device. Also, one other embodiment which comes to mind is a first member similar to that which has been shown with an externally threaded tubular portion laterally extending toward the guide wheel 3. This modified first member would then be rotationally mounted on axle 5 while the second member 14 could then consist of a simple internally threaded annulus screwed onto the tubular extension of the first member 13.

What is claimed is:

1. A guide for an endless belt abrading device (1) of the type having an endless abrasive belt (2) trained over a contact wheel (3), said contact wheel (3) providing support for said belt (2) at the point of contact between said belt (2) and a workpiece (8), said contact wheel (3) being supported by a laterally extending axle (5) which is in turn supported by a contact arm (4) extending outwardly from a motor unit which drives said belt, characterized in that:

said guide includes a laterally disposed guide wheel (6) rotationally disposed on the lateral extension of said axle (5), said guide wheel (6) including a circumferentially round continuous guide ring (11) and means for adjustably varying the radius of said guide ring (11) continuously of its circumference to compensate for variations of the combined radius of said contact wheel (3) and the thickness of said abrasive belt (2).

2. The guide as recited in claim 1, characterized in that said guide ring includes a resilient annular tire (11) and said means for adjustably varying the radius of said guide ring includes a support surface (12) for providing radially outwardly directed support to said tire (11), said support surface (12) having a plurality of different radii at different respective lateral positions.

3. The guide as recited in claim 2, characterized in that said support surface (12) is circumferentially round and continuous.

4. The guide as recited in claim 2, characterized in that said support surface includes a substantially conical annular surface (18) and said means for adjustably varying the radius of said guide ring includes means (14) for laterally displacing said resilient tire (11) to different lateral and radial positions along said conical surface (18).

5. The guide as recited in claim 3, characterized in that said circumferentially round continuous support surface (12) includes a plurality of annular grooves (15) at different lateral positions, each of said annular grooves (15) having a different diameter from the others.

6. The guide as recited in claim 4, characterized in that said conical surface (18) is formed on a first member (13) and said means for laterally displacing said resilient tire comprises a second member (14), said first (13) and second (14) members having threads for engaging one another and for effecting relative lateral movement therebetween upon rotation of one relative to the other.

7. The guide as recited in claim 6, characterized in that one of said first and second members (13,14) is journaled for rotation on said axle (5) whereby they may rotate together as a unit.

8. The guide as recited in claim 2, characterized by further including a pair of said guide wheels (6) mounted on said axle (5).

9. The guide as recited in claim 2, characterized in that said pair of guide wheels (6) are mounted on said axle (5) on opposite sides of said contact wheel (3).

10. The guide as recited in claim 2, characterized in that both of said pair of guide wheels (6) are mounted on said axle (5) on the same side of said contact wheel (3).

11. A guide for abrading device having a moving abrasive surface, characterized in that:

said guide includes a guide wheel (6) having a cylindrically symmetrical support surface (12) having different radial dimensions at different axial positions therealong and a circumferentially round continuous resilient tire (11) mounted on said support surface, and means for positioning said tire (11) at different axial positions along said support surface (12) in order to adjustably determine the radius of said tire, said guide wheel being rotationally mounted on said device with its cylindrical axis of symmetry parallel to said abrasive surface where it contacts a workpiece.

12. The guide as recited in claim 11 characterized in that said tire has a round cross-sectional configuration.

* * * * *